US007845020B2

(12) United States Patent
Jaunault et al.

(10) Patent No.: US 7,845,020 B2
(45) Date of Patent: Dec. 7, 2010

(54) CHAIN MAIL ARTICLE PROVIDED WITH AN ELASTIC TIGHTENING OR TENSIONING BODY

(75) Inventors: Philippe Jaunault, Villemoisan (FR); Sophie Jaunault, Villemoisan (FR); Franck Beneteau, Champtoce sur Loire (FR)

(73) Assignee: Manulatex France, Champtoce-sur-Loire (FR)

( * ) Notice: Subject to any disclaimer, the term of this patent is extended or adjusted under 35 U.S.C. 154(b) by 30 days.

(21) Appl. No.: 12/296,742

(22) PCT Filed: Apr. 5, 2007

(86) PCT No.: PCT/FR2007/051077

§ 371 (c)(1),
(2), (4) Date: Oct. 10, 2008

(87) PCT Pub. No.: WO2007/116188

PCT Pub. Date: Oct. 18, 2007

(65) Prior Publication Data

US 2009/0271908 A1 Nov. 5, 2009

(30) Foreign Application Priority Data

Apr. 10, 2006 (FR) ..... 06 03158

(51) Int. Cl.

| | |
|---|---|
| ***B21F 31/00*** | (2006.01) |
| ***A41D 13/08*** | (2006.01) |
| ***A41D 19/015*** | (2006.01) |
| *A41D 19/00* | (2006.01) |

(52) U.S. Cl. ..... 2/159; 2/161.6; 2/167; 245/4; 245/5; 245/6

(58) Field of Classification Search ..... 245/2, 245/4, 5, 6, 9; 2/16–21, 159, 160, 161.6, 2/167, 338, 339, 247, 910, 251, 252
See application file for complete search history.

(56) References Cited

U.S. PATENT DOCUMENTS 2,044,336 A * 6/1936 Schwartzman ..... 245/5

(Continued)

FOREIGN PATENT DOCUMENTS

DE 202005011181 10/2005

(Continued)

OTHER PUBLICATIONS

International Search Report filed on Nov. 20, 2007 in International Application.

*Primary Examiner*—Bobby H Muromoto, Jr.
(74) *Attorney, Agent, or Firm*—Young & Thompson

(57) ABSTRACT

An article of clothing or a decorative article, at least one portion of which is made of chain mail fabric made of interweaved metal rings, wherein the chain mail fabric portion is associated with at least one resilient member arranged so as to tighten the chain mail fabric on a part of the user's body and/or to draw and tension a portion of the chain mail fabric so as to absorb a local excess of material. At least one of the resilient members is in the form of a flat spring (4) of pin type, consisting of a juxtaposition of elongated wire arms (5) connected in pairs by an elastic joint (6), where an articulation axis of the elastic joint is perpendicular to a plane containing the respective pair of wire arms.

14 Claims, 7 Drawing Sheets

U.S. PATENT DOCUMENTS

| | | | | | |
|---|---|---|---|---|---|
| 2,046,564 | A | * | 7/1936 | Laden | 5/230 |
| 2,256,158 | A | * | 9/1941 | Weisbender | 245/2 |
| 2,380,365 | A | * | 7/1945 | Morrison et al. | 428/61 |
| 2,737,663 | A | * | 3/1956 | Harris | 2/161.6 |
| 3,378,181 | A | * | 4/1968 | Hirsch | 224/178 |
| 4,345,730 | A | * | 8/1982 | Leuvelink | 245/6 |
| 4,583,534 | A | * | 4/1986 | Woods et al. | 602/23 |
| 4,599,751 | A | * | 7/1986 | Bouwhuis | 2/400 |
| 5,088,123 | A | * | 2/1992 | MacDonald | 2/162 |
| 5,442,815 | A | * | 8/1995 | Cordova et al. | 2/161.7 |
| 5,511,241 | A | * | 4/1996 | Ziegler | 2/2.5 |
| 5,568,657 | A | * | 10/1996 | Cordova et al. | 2/167 |
| 5,862,521 | A | * | 1/1999 | van Marwijk et al. | 2/16 |
| 6,052,829 | A | * | 4/2000 | Kindler | 2/167 |
| 6,061,833 | A | | 5/2000 | Smith et al. | |
| 6,076,190 | A | * | 6/2000 | Besson | 2/161.6 |
| 6,137,675 | A | * | 10/2000 | Perkins | 361/679.03 |
| 6,438,759 | B1 | * | 8/2002 | Jaunault et al. | 2/167 |
| 6,457,282 | B1 | * | 10/2002 | O'Toole | 52/81.2 |
| 6,735,780 | B1 | * | 5/2004 | Jaunault et al. | 2/48 |
| 7,062,792 | B2 | * | 6/2006 | Jaunault et al. | 2/161.6 |
| 7,188,373 | B2 | * | 3/2007 | Jaunault et al. | 2/161.6 |
| 7,237,272 | B2 | * | 7/2007 | Botcher | 2/161.6 |
| 2004/0025223 | A1 | * | 2/2004 | Jaunault et al. | 2/159 |
| 2004/0181848 | A1 | * | 9/2004 | Jaunault et al. | 2/161.6 |
| 2005/0144700 | A1 | * | 7/2005 | Lattari | 2/161.6 |
| 2007/0042210 | A1 | * | 2/2007 | Horsham | 428/544 |

FOREIGN PATENT DOCUMENTS

| | | |
|---|---|---|
| FR | 1053579 | 2/1954 |
| FR | 2864752 | 7/2005 |
| GB | 2275174 | 8/1994 |
| WO | 9611595 | 4/1996 |
| WO | 2005011416 | 2/2005 |

* cited by examiner

CHAIN MAIL ARTICLE PROVIDED WITH AN ELASTIC TIGHTENING OR TENSIONING BODY

The present invention relates to articles at least one portion of which is made of chain mail fabric, namely made of interweaved metal rings, in particular clothing or decorative articles, and which are fitted out with at least one resilient member for tightening or tensioning the mail.

The chain mail fabric is widely used in the agri-food industry, in particular in the meat industry, to make notably gloves or aprons intended to protect certain body areas of the operators against cutting or perforation risks linked to the use of cutting or sharp tools.

This sort of fabric is sometimes also used in the fashion or the decoration/architecture industry.

Certain areas of the chain mail fabrics are associated to tightening means, for example the wrist areas of gloves, for the securing on the user's limb. Said tightening means can consist of a spring-type resilient member, as described, for example, in FR-2 864 752, U.S. Pat. No. 6,061,833 or WO-96/11595.

These springs have the advantage that they make easier to pull on and to take off the gloves, but they often have a great thickness which harm the comfort of the user and/or have complex structures, hard to assemble.

Further, due to the structure thereof, the chain mail is a non-resilient supple fabric and has the particularity to be deformable in the direction perpendicular to the stretched state thereof.

So, it is necessary to oversize some of the garment areas, either to enable the garment to be pulled on and taken off, either to have enough material to accommodate the flexion of the joints.

However, the corresponding oversizing creates a chain mail excess in some areas of the garment, after the garment is placed on the user's body. This excess of material is often discomfortable, can be a source of risks and is not very pleasant.

It would thus be interesting to have a simple, efficient and very little discomfortable means, liable to resiliently tighten the chain mail in certain areas, in particular so as to fit better the fitted out part of the user's body, while enabling a temporary extension, in particular to enable the pulling on and taking off operations or for the movements of the joints.

To remedy the abovementioned problems and reach the above described objects, the clothing or decorative article according to the invention comprises a chain mail fabric portion which is fitted out with a tightening and/or tensioning resilient member, formed of a flat spring, of pin type, consisting of a juxtaposition of elongated wire arms connected by pairs by an elastic joint.

This type of spring member, of simple design, has a reduced thickness which enables it to be used in virtually any area of the garment, in particular without causing a considerable discomfort.

According to a particularly interesting characteristic, the elastic joint connecting two juxtaposed arms of the spring has an articulation axis running perpendicular or substantially perpendicular relative to the plane in which run said juxtaposed arms.

This spring can be structured so as to act in compression or in traction.

According to a first embodiment, the used spring consists of a juxtaposition of two arms connected by an elastic joint, forming together a U-shaped or a V-shaped structure.

According to another embodiment, the spring consists of a juxtaposition of at least three arms connected by pairs by an elastic joint, forming a juxtaposition of U-shaped or V-shaped structures disposed head to tail relative to each other.

The joint that connects two juxtaposed arms of the spring advantageously consists of a loop of material having one or more turns. In case of several turns, the latter can be superimposed and/or juxtaposed.

According to another feature, the two free ends of the spring are provided with a loop.

According to still another characteristic, the spring connects at least two spaced-apart metal rings of the chain mail fabric, the connection between said spring and said chain mail is made by means of metal rings, in particular through the abovementioned loops shaped on said spring.

In a possible embodiment, the spring is accommodated in a pocket or a sleeve provided in the chain mail fabric.

According to a particular embodiment, the article made of chain mail fabric comprises at least one flat spring all the arms of which are disposed in a same plane or substantially in a same plane.

According to another possible embodiment, the article is in the form of a garment (glove, apron, one-piece coverall . . . ) provided with a chain mail circular portion intended to surround a part of the user's body, and a flat spring, in the shape of a circular or circular-arc strip, is fastened on at least one part of the periphery of said chain mail circular portion, so as to form a member for tightening the material on said part of the user's body. According to this embodiment, the spring can consist of a juxtaposition of at least two circular-arc sectors.

The invention will be further illustrated, without being in any way limited, by the following description of several possible embodiments given only by way of example and shown in the attached drawings, wherein.

Figure 1:
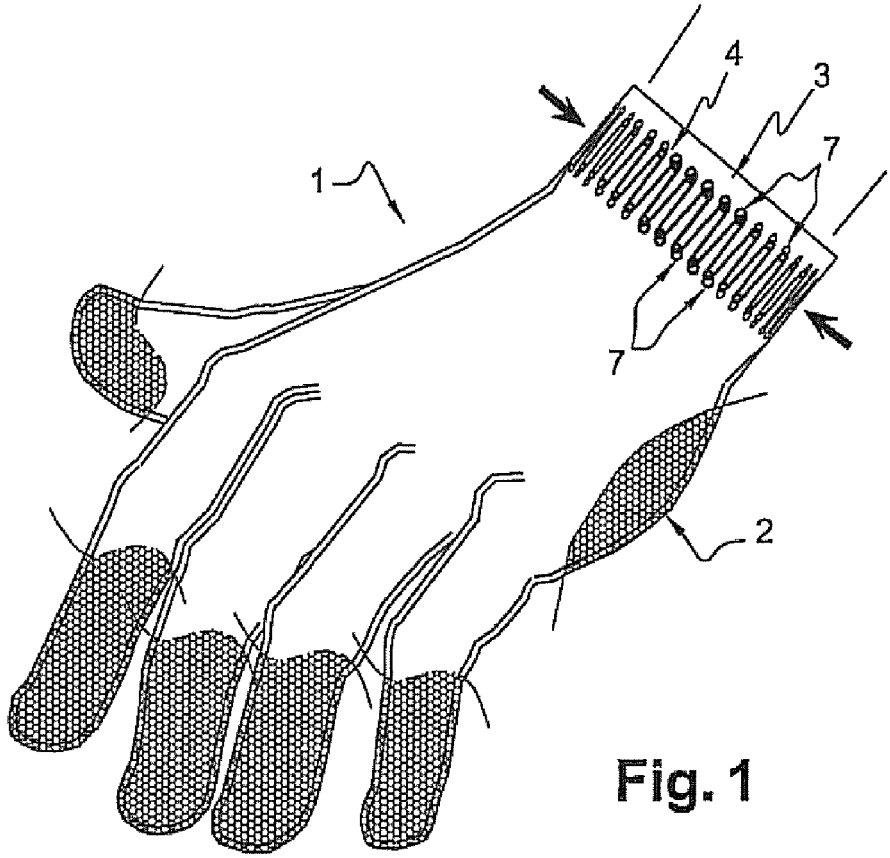
FIG. 1 illustrates a chain mail glove according to the invention, fitted out with a circular flat spring which surrounds the wrist covering area.

The glove 1 illustrated in FIG. 1 is a glove made of chain mail fabric, namely made of a latticework of interweaved metal rings, consisting of a portion 2 intended to cover the hand, extended by a portion 3 intended to cover the wrist.

The wrist portion 3 is fitted out with a tightening resilient element 4 which is in the form of a flat spring having a circular and more particularly cylindrical general configuration. This flat spring 4 entirely surrounds the wrist portion 3 and is adapted to act in compression, in a radial direction toward the wrist axis.

Figure 2:
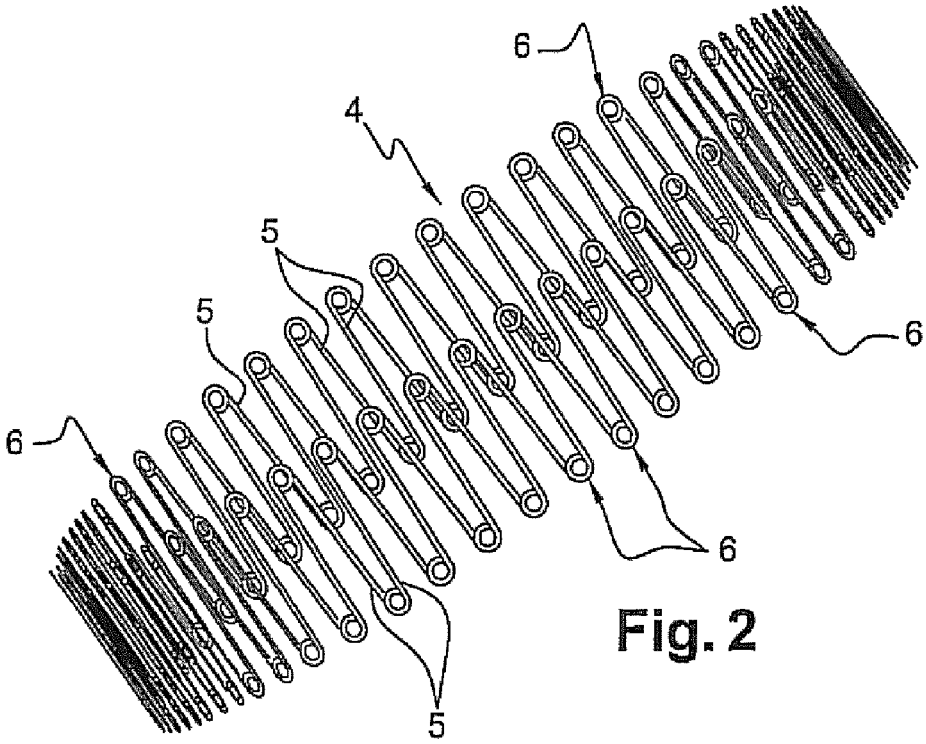
FIG. 2 is a perspective view of the flat spring, taken alone, fitted on the glove of FIG. 1.

This flat spring 4, illustrated alone in FIG. 2, consists of a plurality of arms 5, of elongated wire or wire-made arms type, connected by pairs by an elastic joint 6 to form a juxtaposition of Us or Vs disposed head to tail relative to each other.

The different arms 5 are straight and are herein the same length (for example, comprised between 1 and 3 cm), which may not be always the case. The juxtaposition thereof forms a strip of material which takes by itself a cylindrical configuration due to the unitary appearance thereof.

Arms 5 run on the same virtual cylinder; they are connected by a joint 6 formed of a complete circular loop which can have one or more turns. In the illustrated embodiment, spring 4 is made of metal, for example from a stainless steel wire the diameter of which is comprised between 0.5 and 1 mm. In embodiment variants, it can also be obtained in a plastic, organic or textile material.

Two juxtaposed arms 5 run in a plane perpendicular to the articulation axis of resilient loop 6 that connects them, the corresponding plane is parallel or merged with that of the chain mail fabric fitted out with spring 4.

The arms 5 of this spring member 4 work in traction. Spring 4 is thus adapted to compress the wrist covering area 3 and consequently to strengthen on the wrist of the glove wearer.

In addition to the "elastic joint" function thereof, loops 6 enable spring 4 to be fastened on the chain mail fabric by means of added-on rings 7. In the illustrated embodiment, the closing spring 4 is integrally positioned on an area of the chain mail fabric which forms the wrist portion 3, it is interlocked with the corresponding chain mail fabric through two circular fastening lines, parallel to each other, by means of aforementioned rings 7.

The closing flat spring 4 is preferably fastened on the outer face of the chain mail, but it could also be fastened on the inner side; it can still be interweaved in the chain mail fabric.

In alternative or in addition to the fastening by means of rings 7, flat spring 4 can be accommodated in a chain mail pocket or hem provided on the wrist portion 3.

This type of spring 4 has the advantage of having a much reduced thickness (limited to the diameter of the wire and to the thickness of the loop or loops 6), which enables to limit as much as possible the discomfort caused by the presence thereof, improving consequently the glove comfort of use.

Figure 3:
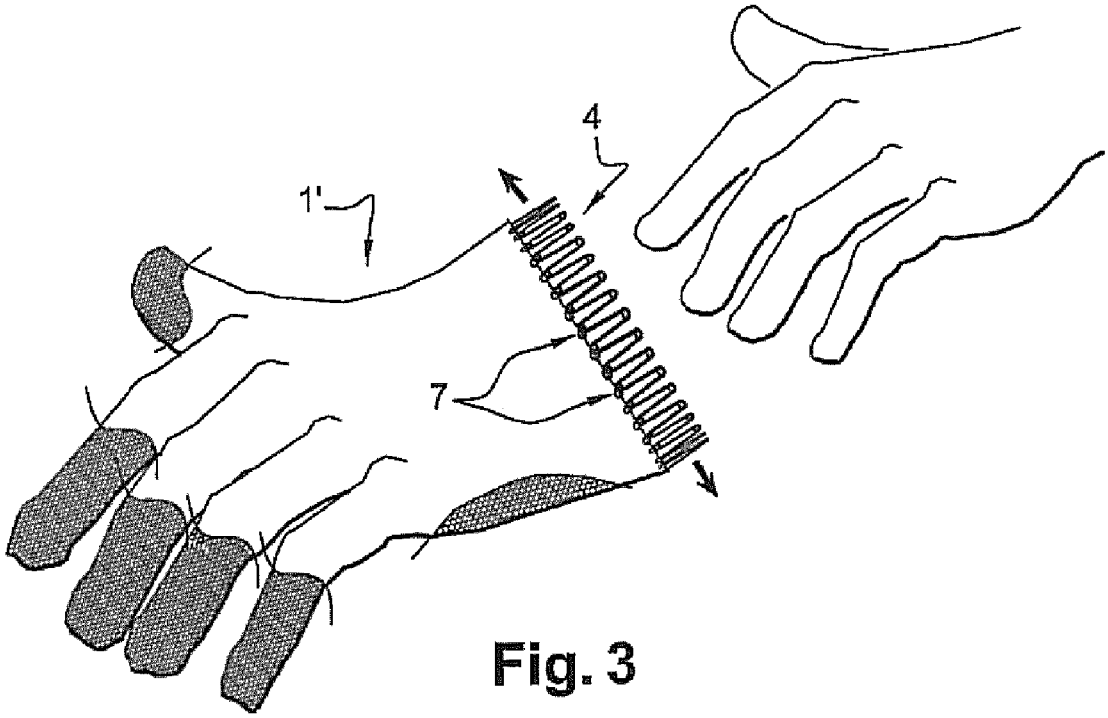
FIG. 3 shows an embodiment variant of the chain mail glove of FIG. 1, in which the circular flat spring is fastened in the extension from the wrist covering area, the corresponding glove being ready to be pulled onto the user's hand.

FIG. 3 shows an embodiment variant of a glove 1' using the same spring member 4 as that described in FIGS. 1 and 2, but is here fastened in the extension from the wrist portion 3, by means of a single line of fastening rings 7.

In FIG. 3, the cylindrical string member 4 is represented in an extended condition important to enable the hand to be inserted in glove 1' through the opening delimited by said spring 4.

Figure 4:
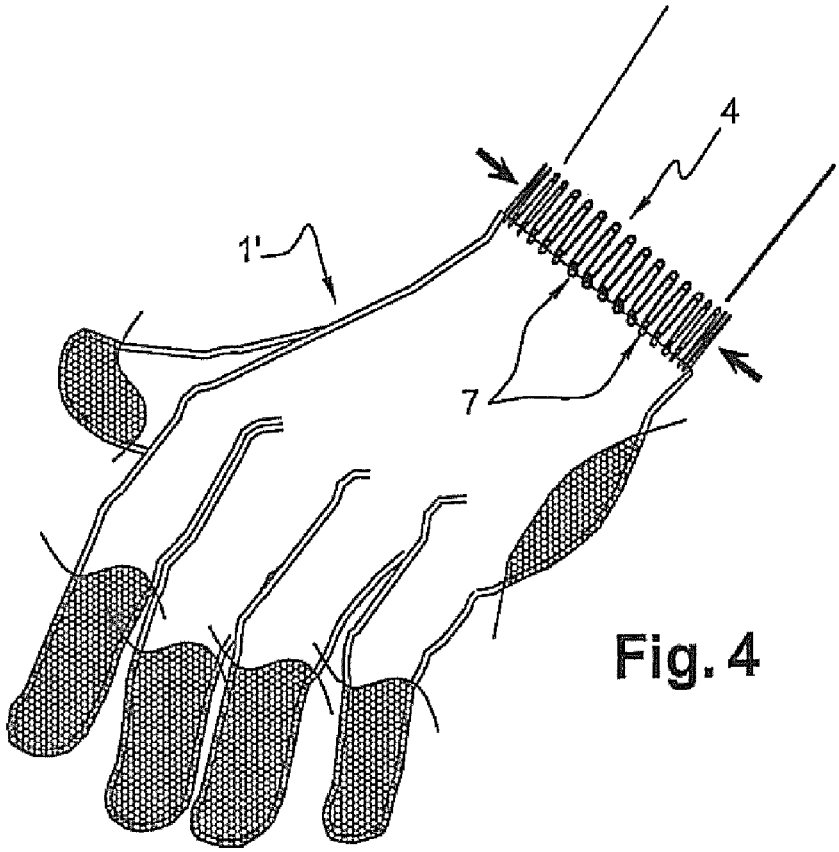
FIG. 4 shows the glove of FIG. 3 after it is pulled onto the user's hand.

In FIG. 4, glove 1' is pulled onto the hand; spring member 4 tightens on the user's wrist acting in compression, in a radial direction.

Once positioned on the user's hand, spring 4 provides a suitable tightening, sufficient to correctly hold the glove, but not too strong so as to avoid a discomfort due to compression.

In the illustrated embodiment in FIGS. 1 to 4, the spring member 4 has a complete circular general shape.

In embodiment variants, it can consist of a simple cylinder portion, or it can be made of several independent sections to form a total or partial cylindrical crown. For example, the resilient member 4 for tightening of the wrist area can be made by means of a juxtaposition of two independent spring members, each intended to hug a half wrist-perimeter so as to obtain, at a "rest" condition (taken off from the user's hand), a flat glove easy to store and to transport.

The flat spring 4 illustrated in FIGS. 1 to 4 can also be used to hug the forearm and/or arm portion, on gloves provided with extensions covering the corresponding limb parts of the user.

Figure 5:
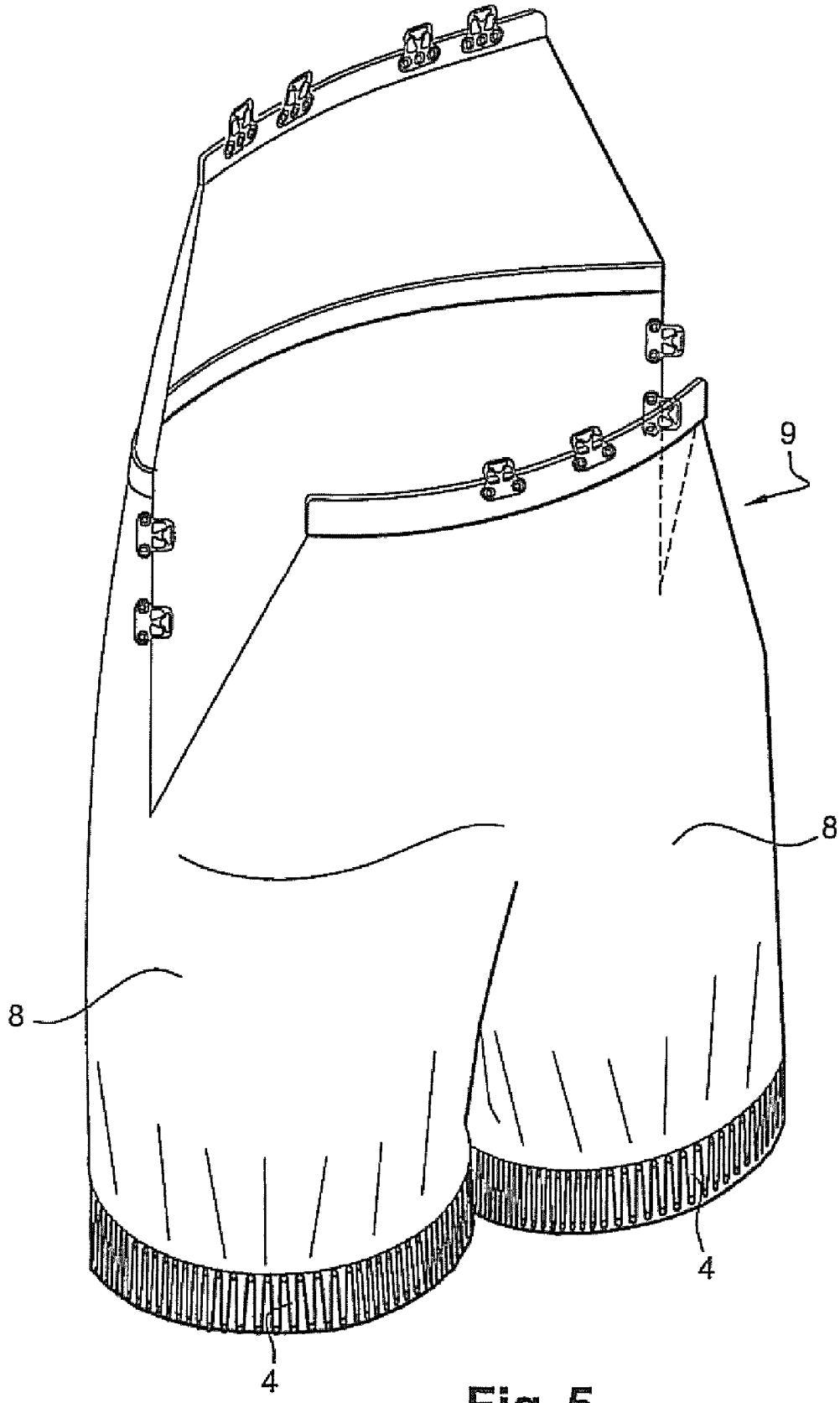
FIG. 5 shows a chain mail one-piece coverall in which the ends of the two sleeves intended to cover the thighs are fitted out with a tightening circular flat spring.

As illustrated in FIG. 5, the flat ring 4 can be fitted on the ends of the leg sleeves 8 of a chain mail one-piece coverall 9, so as to tighten the ends of said sleeves 8 on the user's thighs.

Figure 6:
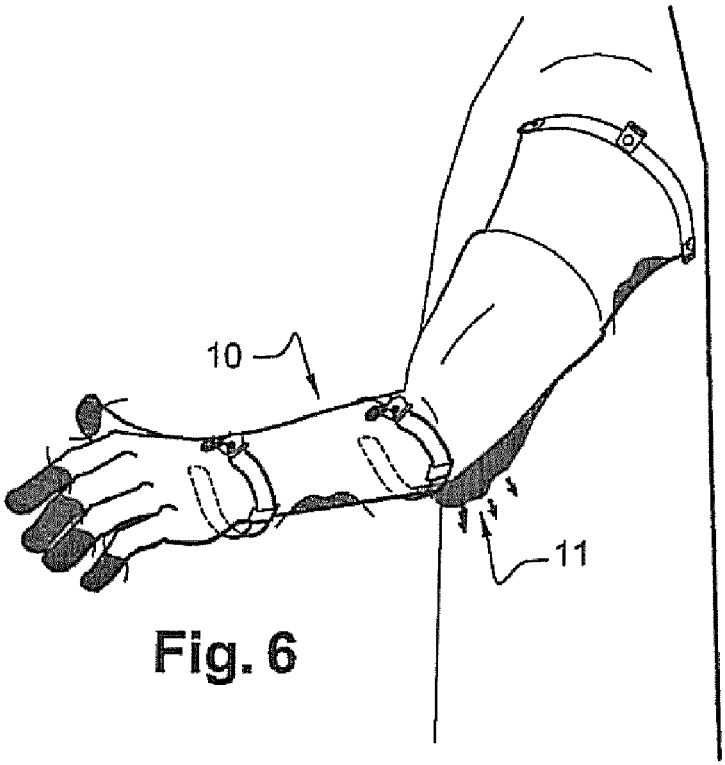
FIG. 6 shows a chain mail glove of the prior art, provided with extension portions intended to cover the forearm and the arm, illustrating the forming of an excess of material at the elbow, in absence of means for tensioning the mail.

FIG. 6 illustrates a chain mail glove 10 of the prior art comprising a hand portion extended by a forearm portion and an arm portion, the wrist, forearm end and arm end areas being provided with a tightening member for the securing on the wearer's limb.

Concerning this glove 10, shown in a lightly flexed position of the arm, it is to be noticed that there is an excess of material 11 at the elbow, linked to the necessary oversizing to enable flexing movements, in relation with the suppleness and the non-resilient character of the chain mail fabric.

Figure 7:
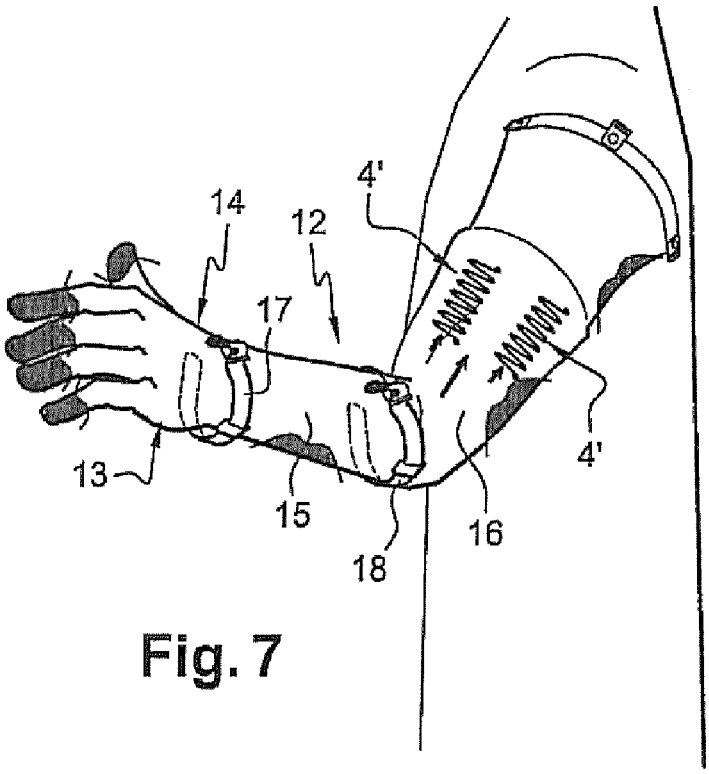
FIG. 7 shows the glove of FIG. 6 fitted out with flat springs for tensioning the mail, at the arm covering portion, enabling the chain mail fabric to fit at best the user's limb.

The glove 12 according to the invention, illustrated in FIG. 7, enables to remedy this problem.

The corresponding glove 12 comprises a portion 13 intended to cover the hand, made of chain mail fabric, extended by a wrist covering portion 14, a forearm covering portion 15 and an arm covering portion 16, all also made of chain mail fabric.

The wrist covering portion 14 and the forearm end portion are provided with a closing system, herein in the form of a tightening strap, respectively 17 and 18. Further, the arm end portion is provided with an element for the connexion to a set of braces or an additional garment.

According to the invention, the arm covering portion 16 is fitted out with resilient members in the form of tension flat springs 4', connecting at least two spaced-apart rings on the chain mail fabric, adapted to continuously draw the chain mail fabric so as to eliminate the excess of material at the elbow (present in the embodiment of FIG. 6).

The number, the tension characteristics and the position of the flat springs 4' are adapted so that they correctly fulfill their function, while limiting the discomfort for the glove wearer.

To this end, in the embodiment illustrated in FIG. 7, at least two flat springs 4' are disposed parallel to each other on the periphery of the arm covering portion 16, with their traction axis in the direction of the arm axis.

Figure 8:
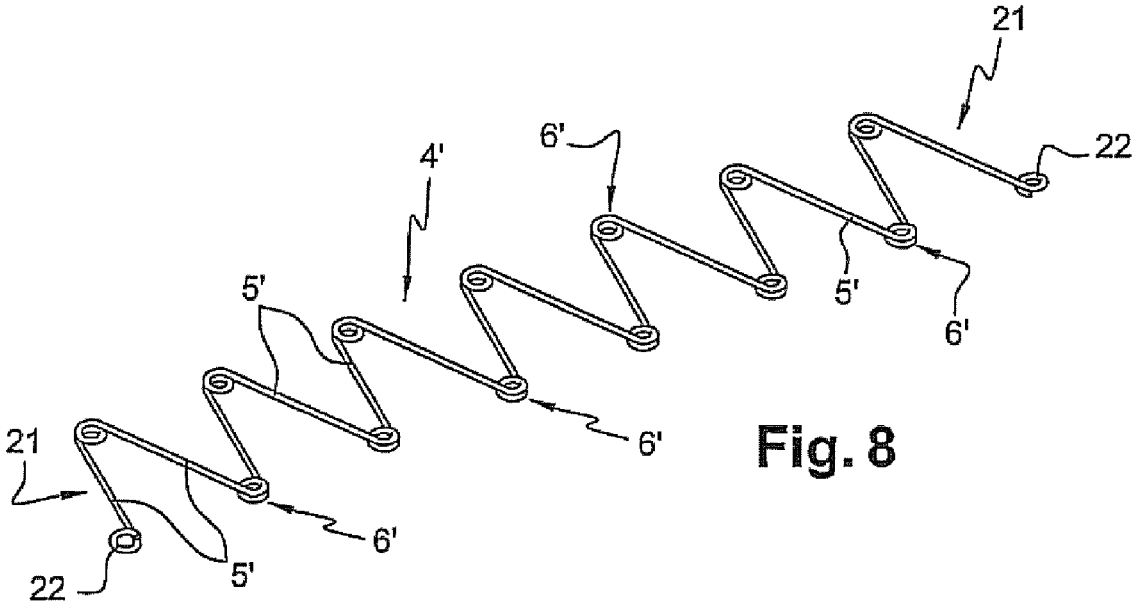
FIG. 8 is a perspective view of the flat spring, taken alone, fitted on the glove of FIG. 7.

FIG. 8 is a perspective view of said flat spring 4', illustrated alone. Further, FIGS. 9 and 10 illustrate in detail the action of this spring on the fitted out chain mail.

The structure of the flat spring 4' is very close to that of the embodiments illustrated in FIGS. 1 to 4. However, it is not herein shaped in a cylinder or a cylinder portion; it has the form of a simple flat or substantially flat resilient strip.

Figure 9:
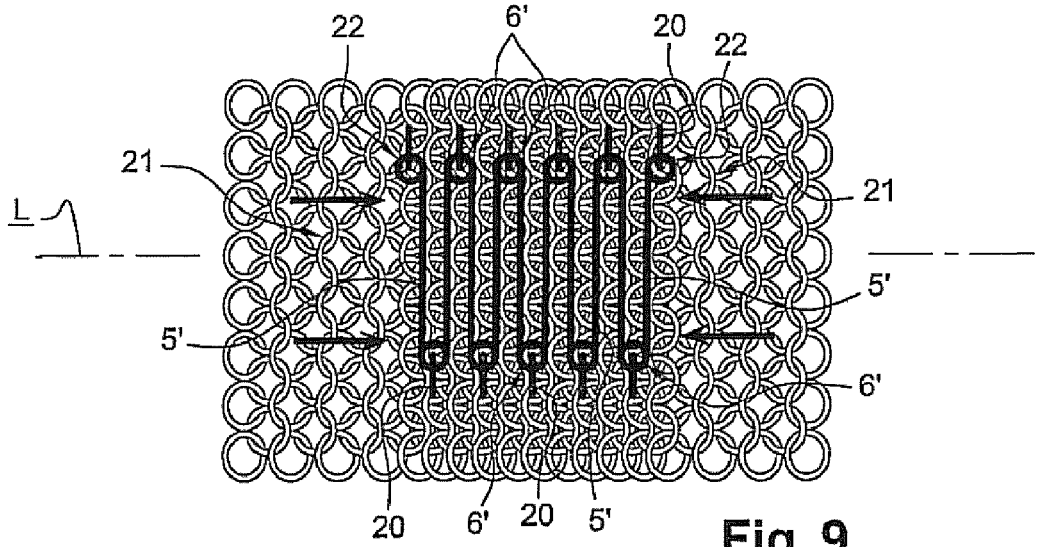
FIG. 9 shows a spring member similar to that used on the glove of FIG. 7, herein illustrated positioned on a chain mail panel and in a stable (rest) state providing a tightening of the material mails.
Figure 10:
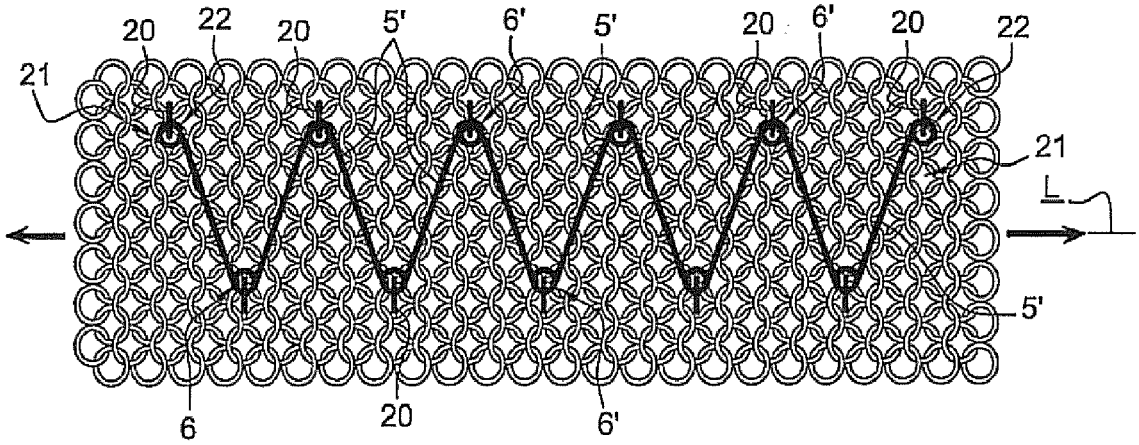
FIG. 10 shows the spring member of FIG. 9, herein illustrated in the tensed state, following a stretching of the chain mail panel.

As illustrated in FIGS. 8, 9 and 10, the flat spring 4' consists of a plurality of elongated wire arms 5' connected by pairs by an elastic joint 6', to form a juxtaposition of Us or Vs disposed head to tail relative to each other. In view of the function and the arrangement of this spring 4', arms 5' all run in the same plane or substantially in the same plane. The corresponding plane is parallel or merged with that of the chain mail fabric fitted out with the spring 4'; and each elastic joint 6' run perpendicular to this plane.

Again, as in the previous embodiment, the spring 4' is made of metal, for example from a stainless steel wire the diameter of which is comprised between 0.5 mm and 1 mm. In variants, it can also be obtained in a plastic, organic or textile material.

Arms 5' are straight and are all herein the same length (which may not be always the case). They are connected by an elastic joint formed by a circular loop 6' which can have one or more turns.

Again, in addition to the "elastic joint" function thereof, loops 6' enable the spring member to be fastened on the chain mail fabric by means of added-on metal rings 20.

In FIGS. 8, 9 and 10, it can be noticed that the free ends 21 of spring 4' are also provided with an additional loop 22 enabling the fastening on the chain mail fabric, also by means of added-on metal rings 20.

The "spring" function of resilient structures 4' is obtained through elastic joints 6', and possibly also through a certain flexibility of arms 5'.

Spring 4' is in the form of a strip that can be 1 to 3 cm wide and that is resilient in the direction of the longitudinal axis L thereof. It is preferably fastened on the outer face of the chain mail fabric, but it is perfectly conceivable to position it on the inner face side of the glove, or else to interweave it within the chain mail fabric.

As abovementioned, spring 4' acts in traction. At rest state, the different arms 5' thereof are close together as illustrated in FIG. 9; in this case, the different arms 5' then run parallel to each other.

On the other hand, an outward traction on the two free ends 21 provides the tensioning or drawing thereof, as illustrated in FIG. 10.

To correctly fulfill the function thereof, spring 4' is fastened on the chain mail so as to provide at rest a tightening of the material, namely an extensive partial superimposition of the rings of the chain mail fabric (FIG. 9).

So, a traction on the chain mail fabric will cause the stretching of the material and in the same time the tensioning of spring 4' (FIG. 10), which will enable the mail to return to the tightened position after the canceling of the abovementioned traction effect.

So, it will be well understood that a suitable arrangement of spring or-springs 4' on the chain mail fabric enables at rest to produce a tightening of the material in the fitted out area, namely in the area in which the springs are placed, causing consequently a traction on the chain mail fabric located In the extension. The corresponding traction is produced in the plane or substantially in the plane of the chain mail.

So, when the user pulls on the fitted out garment or clothing article (in this case, glove 12), the portion fitted out with the tension springs 4' suitably covers the body part thereof. The excess of material related to the abovementioned necessary oversizing is then accumulated at the level of springs 4'. The corresponding excess of material (or the corresponding material stock) is used during the garment pulling on or taking off, or else during the flexion of the joints.

Once positioned on the user's body, the spring members 4' can be arranged so as to be at the rest state, or at a state of light tension.

Again, this spring 4' has a much reduced thickness (limited to the diameter of the wire and to the thickness of the resilient loop or loops 6), which enables to limit as much as possible the discomfort caused by the presence thereof.

Figure 11:
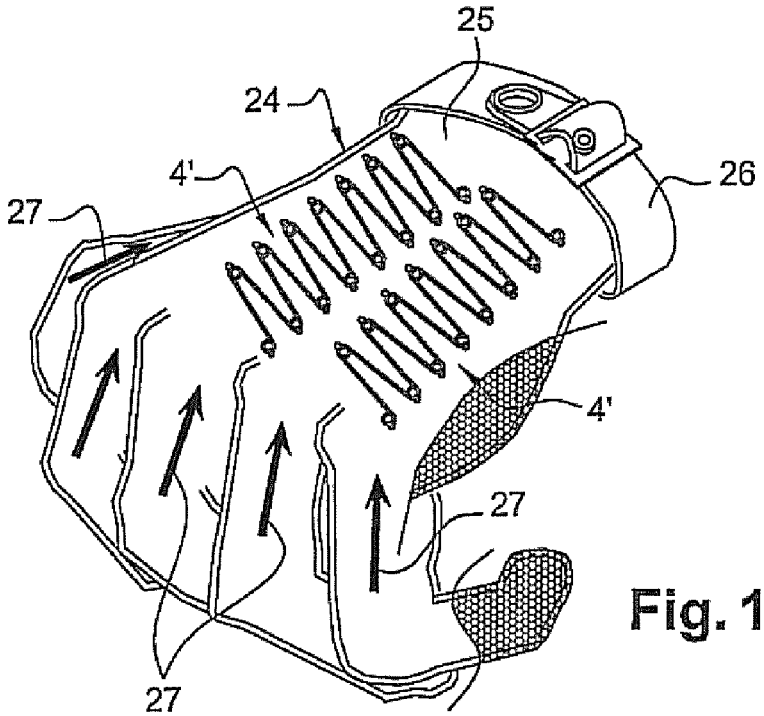
FIG. 11 shows a chain mail glove according to the invention, fitted out with two flat springs on the portion thereof intended to cover the back of the hand.

FIG. 11 shows a chain mail glove 24 extended by a wrist covering portion 25, fitted out with a tightening strap 26.

Here, the portion covering the hand back of the glove is fitted out with two flat springs 4', disposed parallel to each other and fastened on the chain mail fabric so that the working direction thereof is parallel or substantially parallel to the longitudinal axis of the glove fingers. These springs 4' are adapted to continuously draw the chain mail fabric of the glove fingers, toward the wrist portion 25, as illustrated by direction arrows 27.

Consequently, when the user pulls on glove 24, the glove fingers in an extended condition suitably cover the fingers of the hand. The excess of material related to the necessary oversizing of the glove fingers is then accumulated at the level of springs 4' on the hand back portion. The corresponding excess of material (or the corresponding material stock) is used during the flexion of the fingers (FIG. 11). The excess of material at the end of the glove fingers of the prior art (when the fingers are in an extended condition) is thus eliminated.

It is obtained a glove the finger portions of which are continually tensed and which generally fits at best the hand of the user (without needing the presence of added-on members of prior art glove-fastener or glove-tightener type, acting in compression and causing the presence of material over-thicknesses between the fingers).

In an extended condition of the fingers, spring members 4' can be arranged so as to be at the rest state, or at a state of light tension.

This very comfortable glove improves the gripping quality for the user and also optimizes the security.

Figure 12:
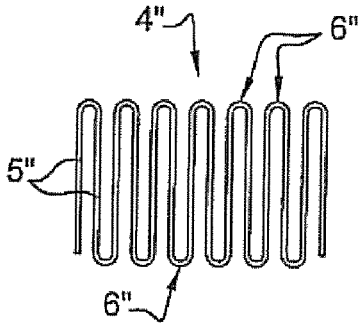
FIG. 12 illustrates a first possible embodiment variant of the spring member, at the rest state.
Figure 13:
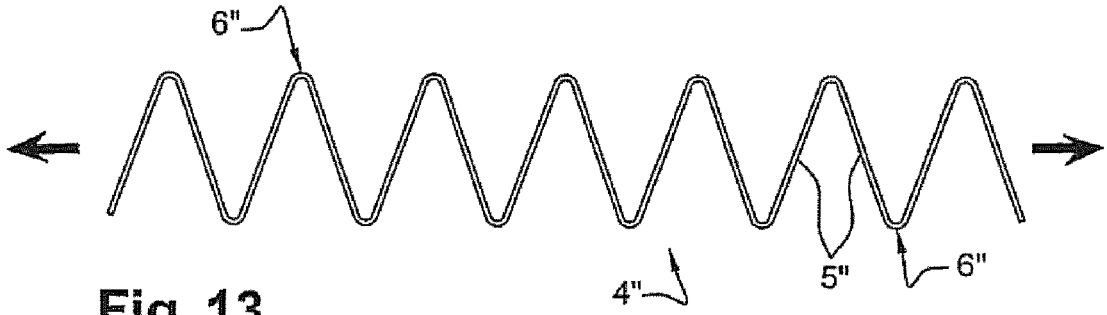
FIG. 13 shows the spring of FIG. 12 at the tensed state (following a stretching of the supporting chain mail fabric)

FIGS. 12 and 13 show a possible embodiment variant of the tension flat spring liable to be used on the garment or the clothing article according to the invention.

This flat spring 4", illustrated at the rest state in FIG. 12 and at the tensed state in FIG. 13, consists of a juxtaposition of arms 5" connected by pairs by an elastic joint 6" herein formed of a simple material bend.

Figure 14:
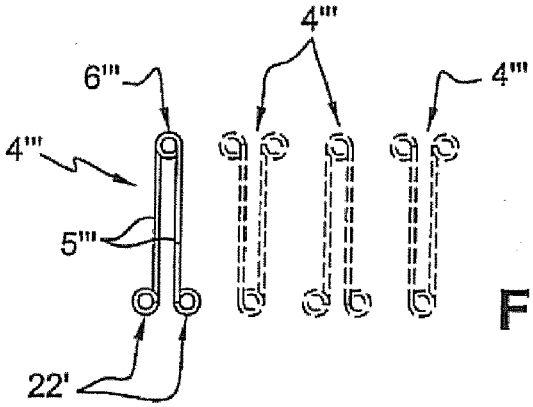
FIG. 14 illustrates a second embodiment variant of the spring member consisting of only two arms connected by an elastic joint.
Figure 15:
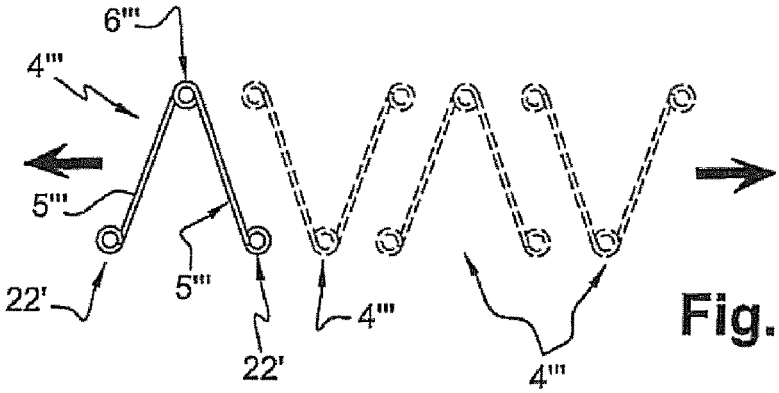
FIG. 15 shows the spring member of FIG. 14 at the tensed state, following a stretching of the supporting chain mail fabric.

A second possible embodiment variant is illustrated in FIGS. 14 and 15.

Herein, the spring member 4''' consists of a simple juxtaposition of two arms 5" connected by a resilient loop 6'''. The free ends of the arms 5''' comprise a supplementary loop 22' enabling spring element 4''' to be fastened on the chain mail fabric by means of added-on rings (or the like); the resilient loops 6''' also serve as fastening members on the chain mail by means of added-on rings (or the like).

As illustrated in dotted line, a plurality of springs 4''' can be associated together to form the resilient member. In this case, the springs are preferably disposed head to tail relative to each other, one after the other.

Generally, flat spring 4, 4', 4", 4''' can be positioned on any area of the garment or of the clothing article where it can prove interesting to obtain an "elastic" tightening of material (which can be compared to an elastic gathering system). Any garment or clothing article at least a portion of which is made of chain mail can be so fitted out: glove, sleeve, cuff, apron, one-piece coverall, vest . . . .

As for the embodiment of FIGS. 1 to 5, springs 4', 4" and 4''' can be accommodated in pockets or sleeves provided at the desired location of the garment or clothing article, in particular a pocket or a sleeve made of chain mail fabric.

Of course, the invention is not limited to the herein described and illustrated embodiments. Thus, for example, the implemented spring member or members can be compression springs then disposed so as to act transversally to the direction in which the traction is desired.

Also, the resilient member or members can be releasably fitted on the garment or clothing article, by any suitable fastening means.

On the other hand, as abovementioned, the invention can also be applied to any fashion, decoration and architecture article comprising a portion made of chain mail fabric, whether in an aesthetic or a functional goal. For example, it is conceivable to use it for fire-break curtains, lamps or curtains for window dressing.

The invention claimed is:

1. An article of clothing or decorative article, at least one portion of which is made of chain mail fabric made of interweaved metal rings, said chain mail portion being associated with at least one resilient member arranged so as to tighten said chain mail fabric on a part of a user's body and/or to draw and tension a portion of said chain mail fabric so as to absorb a local excess of material, wherein at least one of said resilient members is a flat spring (4, 4', 4", 4'") of pin type, consisting of a juxtaposition of elongated wire arms (5, 5', 5", 5'") connected in pairs by an elastic joint (6, 6', 6", 6'"), said elastic joint connecting two of said juxtaposed wire arms having an articulation axis perpendicular to a plane containing said two juxtaposed wire arms and said joint includes a loop of material having one or more 360° turns.

2. The article according to claim 1, wherein said at least one of said resilient member is a compression spring.

3. The article according to claim 1, wherein said at least one of said resilient member is a traction spring (4, 4', 4", 4'").

4. The article according to claim 1, wherein the spring (4'") has a U-shaped or a V-shaped structure.

5. The article according to claim 1, wherein the spring (4, 4', 4") includes a juxtaposition of at least three said arms (5, 5', 5") connected in pairs by a respective said elastic joint (6, 6', 6"), forming a juxtaposition of U-shaped or V-shaped structures disposed head to tail relative to each other.

6. The article according to claim 1, wherein two free ends (21) of the spring (4', 4'") are each provided with a 360° loop (22, 22').

7. The article according to claim 1, wherein the spring (4, 4', 4'") is connected to at least two spaced-apart metal rings of the chain mail fabric with metal rings (7, 20) through 360° loops (6, 6', 6'", 22, 22') on said spring (4, 4', 4'").

8. The article according to claim 1, wherein the spring (4, 4', 4", 4'") is in a pocket in the chain mail fabric.

9. The article according to claim 1, provided with a chain mail circular portion intended to surround a part of the user's body, wherein said at least one resilient member comprises a flat spring (4) that is a circular or circular-arc strip fastened on at least one part of a periphery of said chain mail circular portion so as to form a member for tightening the material on said portion of the user's body.

10. The article according to claim 9, wherein said flat spring includes a juxtaposition of at least two circular-arc sectors.

11. An article of clothing or decorative article comprising:

chain mail fabric made of interweaved metal rings; and a resilient member attached to said chain mail fabric so as to tighten said chain mail fabric, wherein said resilient member is a flat spring including a plurality of wire arms and elastic joints that each connect a respective pair of said wire arms, each of said elastic joints including a 360° loop of elastic material whose axis is perpendicular to a plane containing the respective said pair of wire arms.

12. The article of claim 11, further comprising plural hoops that each extend through a respective said 360° loop of said resilient member and through a respective one of said interweaved metal rings to attach said resilient member to said chain mail fabric.

13. The article of claim 11, wherein said resilient member extends in a complete circle with every said 360° loop being connected to two said wire arms.

14. The article of claim 11, wherein said resilient member extends linearly with a further 360° loop at each distal end that is connected to only one of said wire arms.

* * * * *